US008690704B2

(12) United States Patent
Thomas

(10) Patent No.: US 8,690,704 B2
(45) Date of Patent: Apr. 8, 2014

(54) GOLF CLUB ASSEMBLY AND GOLF CLUB WITH AERODYNAMIC FEATURES

(75) Inventor: James S. Thomas, Fort Worth, TX (US)

(73) Assignee: NIKE, Inc., Beaverton, OR (US)

( * ) Notice: Subject to any disclaimer, the term of this patent is extended or adjusted under 35 U.S.C. 154(b) by 370 days.

(21) Appl. No.: 13/078,279

(22) Filed: Apr. 1, 2011

(65) Prior Publication Data

US 2012/0252597 A1 Oct. 4, 2012

(51) Int. Cl.
*A63B 53/04* (2006.01)

(52) U.S. Cl.
USPC ..... 473/327; 473/328; 473/345

(58) Field of Classification Search
CPC ..... A63B 53/0466; A63B 2053/0433; A63B 59/0088; A63B 2225/01; A63B 2053/0412
USPC ..... 473/324–350, 287–292
See application file for complete search history.

(56) References Cited

U.S. PATENT DOCUMENTS

| | | | | | |
|---|---|---|---|---|---|
| 2,998,254 | A | * | 8/1961 | Rains et al. | 473/336 |
| 3,468,544 | A | | 9/1969 | Antonious | |
| 3,794,328 | A | * | 2/1974 | Gordon | 473/327 |
| 3,845,960 | A | * | 11/1974 | Thompson | 473/336 |
| 3,979,122 | A | * | 9/1976 | Belmont | 473/336 |
| 4,283,057 | A | * | 8/1981 | Ragan | 473/234 |
| 4,444,392 | A | | 4/1984 | Duclos | |
| 4,809,982 | A | * | 3/1989 | Kobayashi | 473/327 |
| 4,930,783 | A | * | 6/1990 | Antonious | 473/242 |
| 5,013,041 | A | * | 5/1991 | Sun et al. | 473/252 |
| 5,054,784 | A | * | 10/1991 | Collins | 473/327 |
| 5,158,296 | A | * | 10/1992 | Lee | 473/327 |
| 5,244,210 | A | * | 9/1993 | Au | 473/252 |
| 5,271,622 | A | * | 12/1993 | Rogerson | 473/234 |
| 5,524,890 | A | | 6/1996 | Kim et al. | |
| 5,529,303 | A | * | 6/1996 | Chen | 473/327 |
| 5,681,227 | A | | 10/1997 | Sayrizi | |
| 5,688,189 | A | * | 11/1997 | Bland | 473/314 |
| 5,807,187 | A | * | 9/1998 | Hamm | 473/327 |
| 5,908,357 | A | * | 6/1999 | Hsieh | 473/327 |
| 5,913,733 | A | | 6/1999 | Bamber | |
| 6,165,080 | A | * | 12/2000 | Salisbury | 473/327 |
| 6,482,106 | B2 | * | 11/2002 | Saso | 473/327 |
| 6,824,474 | B1 | | 11/2004 | Thill | |
| 7,351,161 | B2 | * | 4/2008 | Beach | 473/334 |
| 7,559,854 | B2 | * | 7/2009 | Harvell et al. | 473/334 |
| 8,182,364 | B2 | * | 5/2012 | Cole et al. | 473/335 |
| 2007/0093315 | A1 | * | 4/2007 | Kang | 473/342 |
| 2007/0293341 | A1 | * | 12/2007 | Jeong | 473/327 |
| 2010/0022325 | A1 | * | 1/2010 | Doran | 473/327 |
| 2010/0311517 | A1 | | 12/2010 | Tavares et al. | |

FOREIGN PATENT DOCUMENTS

| | | |
|---|---|---|
| GB | 2212402 | 7/1989 |

* cited by examiner

*Primary Examiner* — Sebastiano Passaniti
(74) *Attorney, Agent, or Firm* — Banner & Witcoff, Ltd.

(57) ABSTRACT

A golf club head includes a body member having a length dimension, a height dimension, a breadth dimension, a center-of-gravity and a face-squared centerline. The body member includes a channel having an inlet, an outlet and a throughbore extending through the body member from the inlet to the outlet. The inlet is located to a heel-side of the centerline of the body member and the outlet is located to a toe-side of the centerline of the body member. A golf club including the golf club head is also provided.

19 Claims, 15 Drawing Sheets

GOLF CLUB ASSEMBLY AND GOLF CLUB WITH AERODYNAMIC FEATURES

RELATED APPLICATIONS

The present patent application incorporates herein by reference in its entirety U.S. patent application Ser. No. 12/779,669, filed May 13, 2010, entitled "Golf Club Assembly and Golf Club With Aerodynamic Features," and naming Gary Tavares, et al. as inventors.

FIELD

Aspects of this invention relate generally to golf clubs and golf club heads, and, in particular, to golf clubs and golf club heads with improved aerodynamic features.

BACKGROUND

The distance a golf ball travels when struck by a golf club is determined in large part by club head speed at the point of impact with the golf ball. Club head speed in turn can be affected by the wind resistance or drag provided by the club head during the entirety of the swing, especially given the large club head size of a driver. The club head of a driver or a fairway wood in particular produces significant aerodynamic drag during its swing path. The drag produced by the club head leads to reduced club head speed and, therefore, reduced distance of travel of the golf ball after it has been struck.

Air flows in a direction opposite to the golf club head's trajectory over those surfaces of the golf club head that are roughly parallel to the direction of airflow. An important factor affecting drag is the behavior of the air flow's boundary layer. The "boundary layer" is a thin layer of air that lies very close to the surface of the club head during its motion. As the airflow moves over the surfaces, it encounters an increasing pressure. This increase in pressure is called an "adverse pressure gradient" because it causes the airflow to slow down and lose momentum. As the pressure continues to increase, the airflow continues to slow down until it reaches a speed of zero, at which point it separates from the surface. The air stream will hug the club head's surfaces until the loss of momentum in the airflow's boundary layer causes it to separate from the surface. The separation of the air streams from the surfaces results in a low pressure separation region behind the club head (i.e., at the trailing edge as defined relative to the direction of air flowing over the club head). This low pressure separation region creates pressure drag. The larger the separation region, the greater the pressure drag.

During a golfer's backswing, the ball striking face, which starts at an address position, twists outwardly away from the golfer (i.e., clockwise when viewed from above for a right-handed golfer) due to rotation of the golfer's hips, torso, arms, wrists and/or hands. During the downswing, the ball striking face rotates back into the point-of-impact position. During the downswing, the golf club head may be rotated by about 90° or more around the longitudinal axis of its shaft during the 90° of downswing prior to the point of impact with the golf ball. In fact, the heel/hosel region of the club head leads the swing during a significant portion of the entire downswing and the ball striking face only leads the swing at (or immediately before) the point of impact with the golf ball.

Additionally, during the final 90° portion of the downswing, the club head may be accelerated to approximately 65 miles per hour (mph) to over 100 mph, and in the case of some professional golfers, to as high as 140 mph. As the speed of the club head increases, typically so does the drag acting on the club head. Thus, during this final 90° portion of the downswing, as the club head travels at speeds upwards of 100 mph, the drag force acting on the club head could significantly retard any further acceleration of the club head.

The summation of the drag forces during the entire downswing provides the total drag work experienced by the club head. Calculating the percent reduction in the drag work throughout the course of the entire downswing can produce a very different result than calculating the percent reduction in drag force at the point of impact only. Thus, club heads that have been designed to reduce the drag of the head at the point of impact, or from the point of view of the club face leading the swing, may not function well to reduce the drag during other phases of the swing cycle, such as when the heel/hosel region of the club head is leading the downswing. The drag-reducing structures described below provide various means to reduce the total drag, not just reducing the drag at the point-of-impact. Reducing the total drag of the club head would result in improved club head speed and increased distance of travel of the golf ball.

It would be desirable to provide a golf club head that reduces or overcomes some or all of the difficulties inherent in prior known devices. Particular advantages will be apparent to those skilled in the art, that is, those who are knowledgeable or experienced in this field of technology, in view of the following disclosure of the invention and detailed description of certain embodiments.

SUMMARY

This application discloses a golf club head with improved aerodynamic performance. In accordance with certain aspects, a golf club head may include a body member having a ball striking face, a crown, a toe, a heel, a sole, a back, and a hosel region located at the intersection of the ball striking face, the heel, the crown and the sole. A drag reducing structure on the body member may be configured to reduce drag for the club head during at least a portion of a golf downswing from an end of a backswing through a point-of-impact with the golf ball, and optionally, through at least the last 90° of the downswing up to and immediately prior to impact with the golf ball.

In accordance with certain aspects, a golf club head includes a body member having a length dimension, a height dimension, a breadth dimension, a center-of-gravity and a face-squared centerline. The body member includes a channel having an inlet, an outlet and a throughbore extending through the body member from the inlet to the outlet. The inlet is located to a heel-side of the centerline of the body member and the outlet is located to a toe-side of the centerline of the body member.

The body member may include a hosel configured for attachment to a golf club shaft and the inlet may be located within 4.0 cm of a longitudinal axis of the hosel. The inlet may be located closer to a ball striking face of the body member than is the outlet. The channel may be angled from 10 degrees to 90 degrees from the centerline.

The inlet and the outlet may be seen when the club head is viewed from a sole-side of the body member along an axis extending from the center-of-gravity in a direction parallel to the height dimension. Further, a diffuser may be located on a sole of the body member and the inlet may be located at the leading edge of the diffuser and the outlet may be located at the trailing edge of the diffuser.

The throughbore may be at least partially curved. The minimum cross-sectional area of the throughbore may range from 30 $mm^2$ to 100 $mm^2$. The cross-sectional area of the inlet may be less than the cross-sectional area of the outlet.

According to other aspects, a golf club head includes a body member having a length dimension, a height dimension, a breadth dimension, a center-of-gravity and a face-squared centerline. The body member includes a channel having an inlet, an outlet and a throughbore for a passage of air therethrough. The inlet may be seen when the body member is viewed from a heel-side of the body member along an axis extending from the center-of-gravity in a direction parallel to the length dimension.

Further, the inlet may be seen when the body member is viewed from a sole-side of the body member along an axis extending from the center-of-gravity in a direction parallel to the height dimension.

The outlet may be seen when the body member is viewed from the toe-side of the body member along an axis extending from the center-of-gravity in a direction parallel to the length dimension. Optionally, the outlet may be seen when the body member is viewed from the sole-side of the body member along an axis extending from the center-of-gravity in a direction parallel to the height dimension. Alternatively, the outlet may be seen when the body member is viewed from the back-side of the body member along an axis extending from the center-of-gravity in a direction parallel to the breadth dimension.

According to certain aspects, golf clubs including the disclosed golf club heads are also provided.

These and additional features and advantages disclosed here will be further understood from the following detailed disclosure of certain embodiments.

Figure 1A:
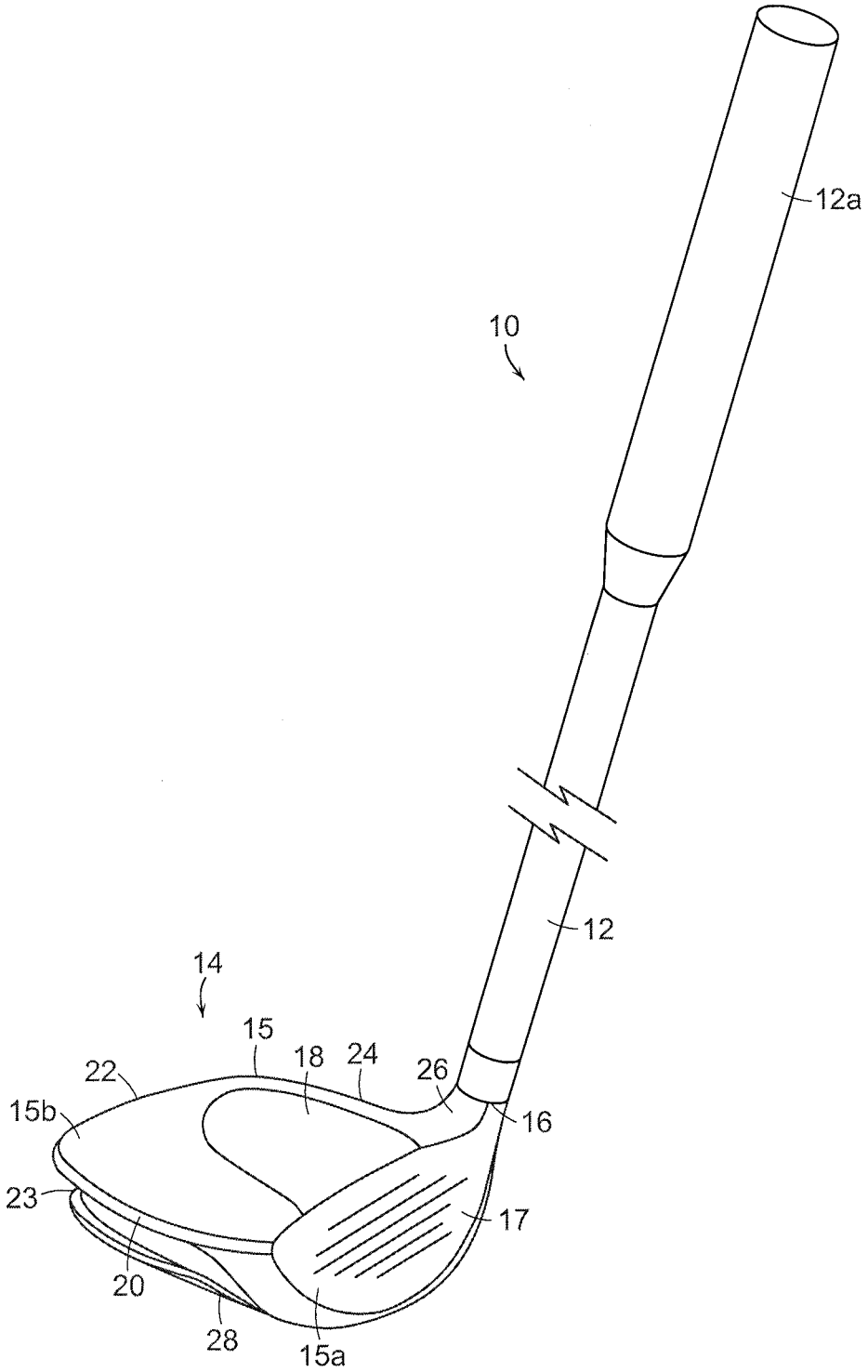
FIG. 1 is a perspective view of a golf club with a groove formed in its club head according to an illustrative aspect.

The figures referred to above are not drawn necessarily to scale, should be understood to provide a representation of particular embodiments of the invention, and are merely conceptual in nature and illustrative of the principles involved. Some features of the golf club head depicted in the drawings may have been enlarged or distorted relative to others to facilitate explanation and understanding. The same reference numbers are used in the drawings for similar or identical components and features shown in various alternative embodiments. Golf club heads as disclosed herein would have configurations and components determined, in part, by the intended application and environment in which they are used.

DETAILED DESCRIPTION

An illustrative embodiment of a golf club 10 is shown in FIG. 1 and includes a shaft 12 and a golf club head 14 attached to the shaft 12. Golf club head 14 may be a driver, as shown in FIG. 1. The shaft 12 of the golf club 10 may be made of various materials, such as steel, aluminum, titanium, graphite, or composite materials, as well as alloys and/or combinations thereof, including materials that are conventionally known and used in the art. Additionally, the shaft 12 may be attached to the club head 14 in any desired manner, including in conventional manners known and used in the art (e.g., via adhesives or cements at a hosel element, via fusing techniques (e.g., welding, brazing, soldering, etc.), via threads or other mechanical connectors (including releasable and adjustable mechanisms), via friction fits, via retaining element structures, etc.). A grip or other handle element 12*a* may be positioned on the shaft 12 to provide a golfer with a slip resistant surface with which to grasp golf club shaft 12. The grip element 12*a* may be attached to the shaft 12 in any desired manner, including in conventional manners known and used in the art (e.g., via adhesives or cements, via threads or other mechanical connectors (including releasable connectors), via fusing techniques, via friction fits, via retaining element structures, etc.).

In the example structures of FIGS. 1-6, each of the club heads 14 includes a body member 15 to which the shaft 12 may be attached at a hosel or socket 16 configured for receiving the shaft 12 in known fashion. The body member 15 includes a plurality of portions, regions, or surfaces as defined herein. The body member 15 includes a ball striking face 17, a crown 18, a toe 20, a back 22, a heel 24, a hosel region 26 and a sole 28. This particular example body member 15 further includes a Kammback feature 23 and a recess or diffuser 36 formed in sole 28.

Alternatively, for purposes of describing the club head 14, the body member 15 may be described as having a front body member 15*a* and an aft body member 15*b*. Front body member 15*a* includes the ball striking face 17 and those portions of the crown 18, toe 20, sole 28 and hosel region 26 that lie forward of the longitudinal axis of the shaft 12 (when the club head is in a 60 degree lie angle position, see below). Further, the front body member 15*a* generally includes the socket 16. Aft body member 15*b* includes the remaining portions of the club head 14.

Figure 2:
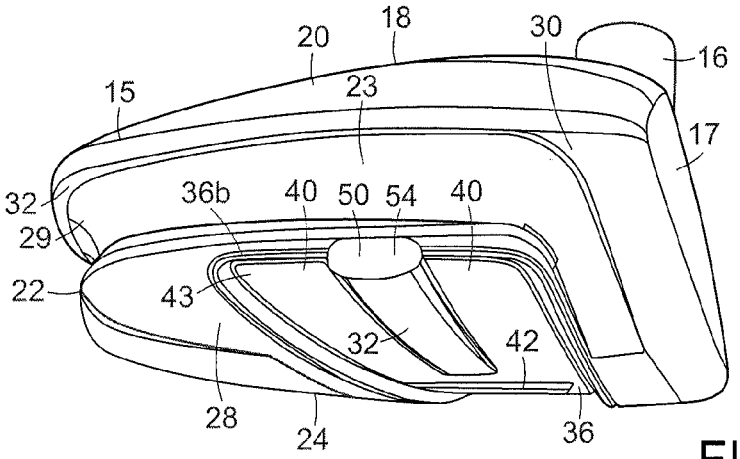
FIG. 2 is a side perspective view of the club head of the golf club of FIG. 1.

Referring to FIG. 2, the ball striking face 17 may be essentially flat or it may have a slight curvature or bow (also known as "bulge" and/or "roll"). Although the golf ball may contact the ball striking face 17 at any spot on the face, the desired-point-of-contact 17*a* of the ball striking face 17 with the golf ball is typically approximately centered within the ball striking face 17.

Figure 23A:
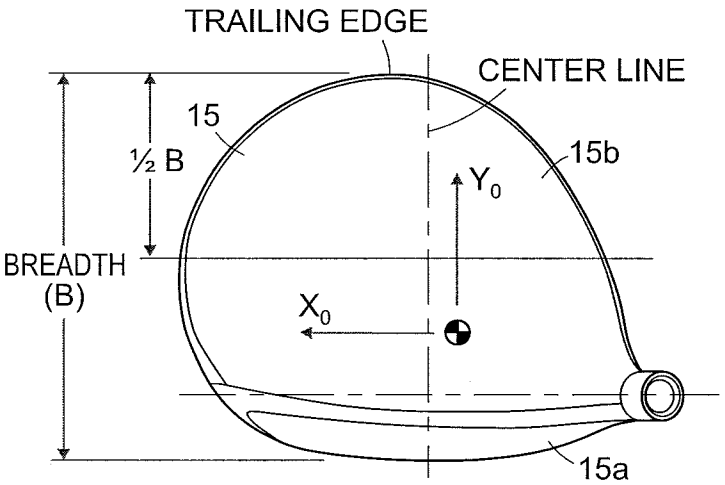
FIGS. 23A and 23B are schematics (top plan view and front elevation) of a club head illustrating certain other physical parameters.
Figure 23B:
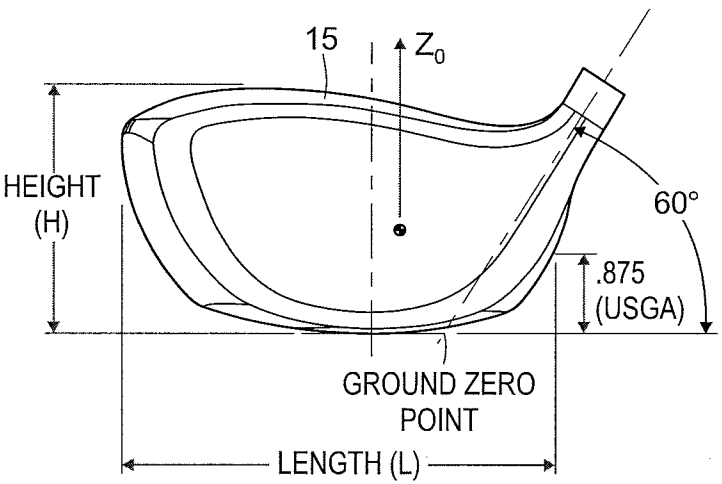

For purposes of this disclosure, and referring to FIGS. 23A and 23B, with a club head positioned at a 60° lie angle as defined by the USGA (see USGA, "Procedure for Measuring the Club Head Size of Wood Clubs"), the "centerline" of the club head 14 may be considered to coincide with the indicator on a face squaring gauge when the face squaring gauge reads zero (and when the face angle is zero). This centerline may be referred to as a "face-squared centerline." The length (L) of the club head extends from the outermost point of the toe to the outermost point of the heel, as defined by the above-referenced USGA procedure. The breadth (B) of the club head extends from the outermost point of the face to the outmost point of the back. Similar to the procedure for determining the outermost point of the toe (but now turned 90°), the outermost points of the face and back may be defined as the points of contact between the club head in the USGA 60° lie angle position with a vertical plate running parallel to the longitudinal axis of the shaft 12. The height (H) of the club head extends from the uppermost point of the crown to the lowermost point of the sole, as defined by the above-referenced USGA procedure. An $X_0$ axis is defined as extending through the center-of gravity of the club head in a direction parallel to the length dimension; a $Y_0$ axis is defined as extending through the center-of gravity of the club head in a direction parallel to the breadth dimension; a $Z_0$ axis is defined as extending through the center-of gravity of the club head in a direction parallel to the height dimension. The terms "above," "below," "front," "back," "heel-side," "toe-side," "sole-side," etc. all may refer to views or portions of the club head associated with the club head 14 when it is positioned at this USGA 60° lie angle.

Referring back to FIGS. 1-6, the crown 18, which is located on the upper side of the club head 14, extends from the ball striking face 17 back toward the back 22 of the golf club head 14. When the club head 14 is viewed from below along the $Z_0$ axis (see FIG. 23B), the crown 18 cannot be seen.

The sole 28, which is located on the lower or ground side of the club head 14 opposite to the crown 18, extends from the ball striking face 17 back toward the back 22. As with the crown 18, the sole 28 extends across the width of the club head 14, from the heel 24 to the toe 20. When the club head 14 is viewed from above along the $Z_0$ axis (see FIG. 23B), the sole 28 cannot be seen.

The back 22 is positioned opposite the ball striking face 17, is located between the crown 18 and the sole 28, and extends from the heel 24 to the toe 20. When the club head 14 is viewed from the front along the $Y_0$ axis (see FIG. 23A), the back 22 cannot be seen.

The heel 24 extends from the ball striking face 17 to the back 22. When the club head 14 is viewed from the toe-side along the $X_0$ axis (see FIG. 23A), the heel 24 cannot be seen.

The toe 20 is shown as extending from the ball striking face 17 to the back 22 on the side of the club head 14 opposite to the heel 24. When the club head 14 is viewed from the heel-side along the $X_0$ axis (see FIG. 23A), the toe 20 cannot be seen.

The socket 16 for attaching the shaft 12 to the club head 14 is located within the hosel region 26. The hosel region 26 is shown as being located at the intersection of the ball striking face 17, the heel 24, the crown 18 and the sole 28 and may encompass those portions of the heel 24, the crown 18 and the sole 28 that lie adjacent to the socket 16. Generally, the hosel region 26 includes surfaces that provide a transition from the socket 16 to the ball striking face 17, the heel 24, the crown 18 and/or the sole 28.

Thus it is to be understood that the terms: the ball striking face 17, the crown 18, the toe 20, the back 22, the heel 24, the hosel region 26 and the sole 28, refer to general regions or portions of the body member 15. In some instances, the regions or portions may overlap one another. Further, it is to be understood that the usage of these terms in the present disclosure may differ from the usage of these or similar terms in other documents. It is to be understood that in general, the terms toe, heel, ball striking face and back are intended to refer to the four sides of a golf club, which make up the perimeter outline of a body member when viewed directly from above when the golf club is in the USGA 60° lie angle position.

In the embodiment illustrated in FIGS. 1-6, body member 15 may generally be described as a "square head." Although not a true square in geometric terms, crown 18 and sole 28 of square head body member 15 are substantially square as compared to a traditional round-shaped club head.

Another embodiment of a club head 14 is shown as club head 154 in FIGS. 7-10. Club head 154 has a more traditional round head shape. It is to be appreciated that the phrase "round head" does not refer to a head that is completely round but, rather, one with a generally or substantially round profile.

A further embodiment of the club head 14 is shown as club head 64 in FIGS. 11-16A. Club head 64 is a generally "square head" shaped club. Club head 64 includes ball-striking surface 17, crown 18, a sole 28, a heel 24, a toe 20, a back 22 and a hosel region 26.

Figure 13:
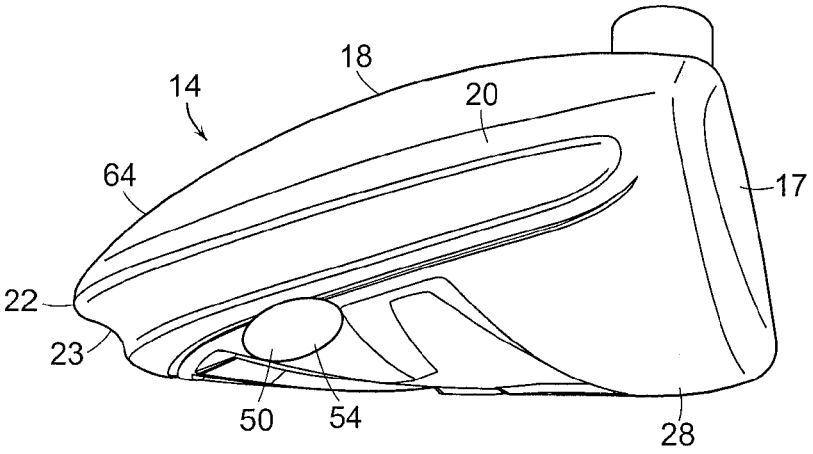
FIG. 13 is a toe-side elevation view of the club head of FIG. 11.
Figure 14:
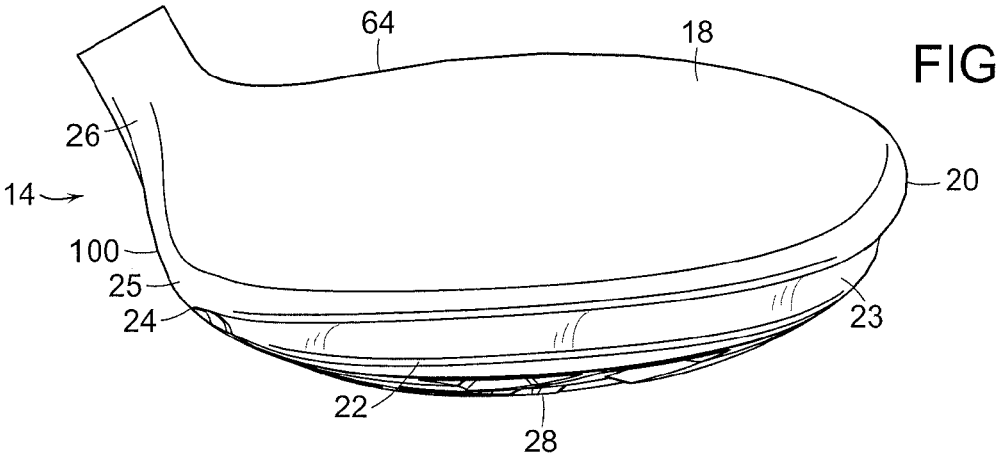
FIG. 14 is a back-side elevation view of the club head of FIG. 11.
Figure 15:
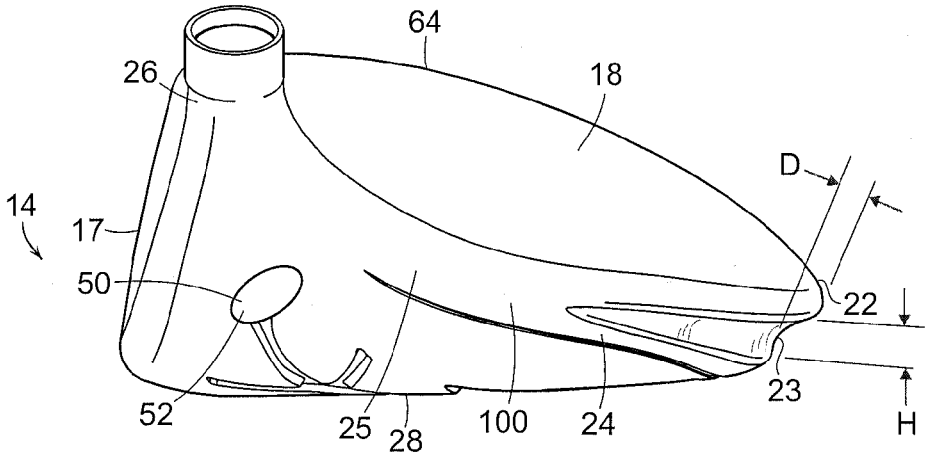
FIG. 15 is a heel-side elevation view of the club head of FIG. 11.

A Kammback feature 23, located between the crown 18 and the sole 28, continuously extends from a forward portion (i.e., a region that is closer to the ball striking face 17 than to the back 22) of the toe 20 to the back 22, across the back 22 to the heel 24 and into a rearward portion of the heel 24. Thus, as best seen in FIG. 13, the Kammback feature 23 extends along a majority of the length of the toe 20. As best seen in FIG. 15, the Kammback feature extends along a minority of the length of the heel 24. In this particular embodiment, Kammback feature 23 is a concave groove having a maximum height (H) that may range from approximately 10 mm to approximately 20 mm and a maximum depth (D) that may range from approximately 5 mm to approximately 15 mm.

Figure 16A:
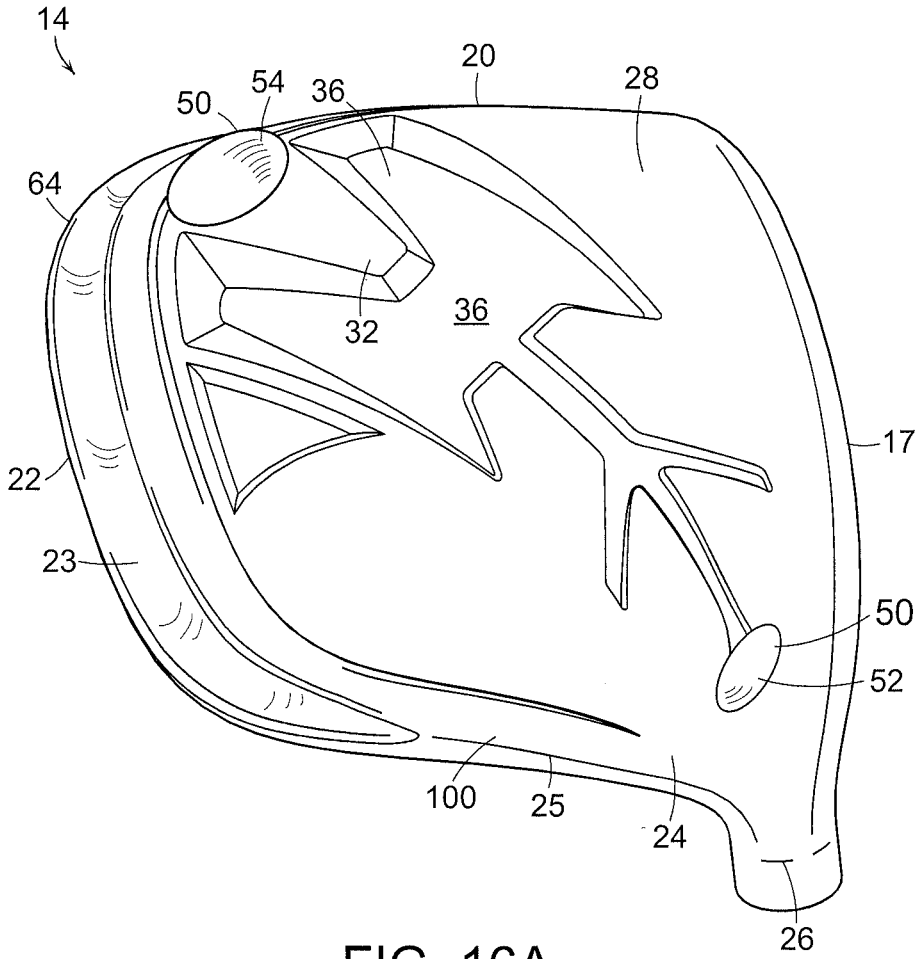
FIG. 16A is a bottom perspective view of the club head of FIG. 11.

One or more diffusers 36 may be formed in sole 28, as shown in FIG. 16A. In an alternative embodiment of club head 14 as shown as club head 74 in FIG. 16B, the sole 28 may be formed without a diffuser.

Referring back to FIGS. 12, 14 and 15, in the heel 24, from the tapered end of the Kammback feature 23 to the hosel region 26, a streamlined region 100 having a surface 25 that is generally shaped as the leading surface of an airfoil may be provided. As disclosed below in greater detail, this streamlined region 100 and the airfoil-like surface 25 may be configured so as to achieve aerodynamic benefits as the air flows over the club head 14 during a downswing stroke of the golf club 10. In particular, the airfoil-like surface 25 of the heel 24 may transition smoothly and gradually into the crown 18. Further, the airfoil-like surface 25 of the heel 24 may transition smoothly and gradually into the sole 28. Even further, the airfoil-like surface 25 of the heel 24 may transition smoothly and gradually into the hosel region 26.

A further embodiment of the club head 14 is shown as club head 84 in FIGS. 17-22A. Club head 84 is a generally "round head" shaped club. Club head 84 includes ball-striking surface 17, crown 18, a sole 28, a heel 24, a toe 20, a back 22 and a hosel region 26.

Figure 19:
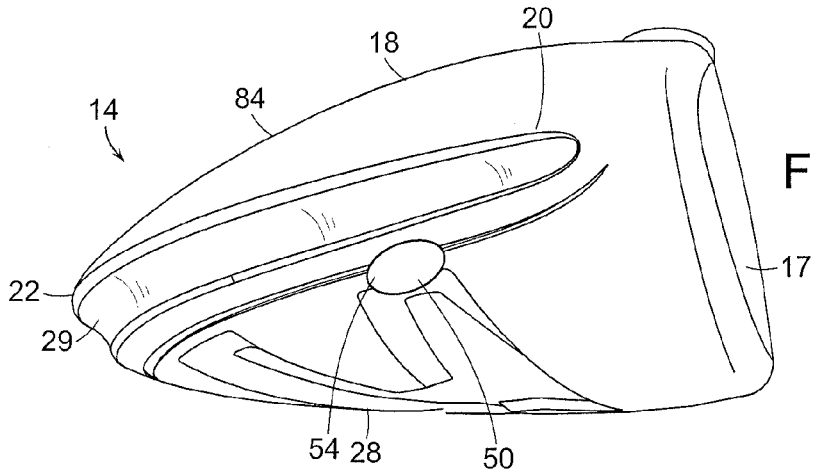
FIG. 19 is a toe-side elevation view of the club head of FIG. 17.
Figure 20:
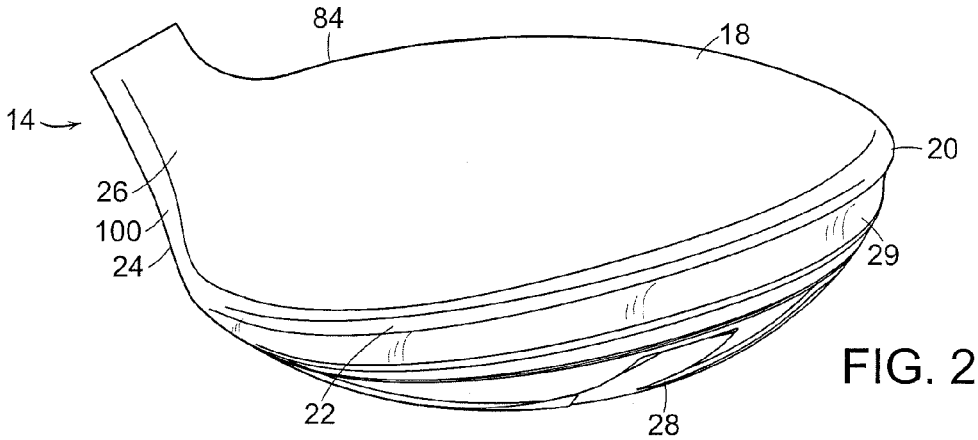
FIG. 20 is a back-side elevation view of the club head of FIG. 17.
Figure 21:
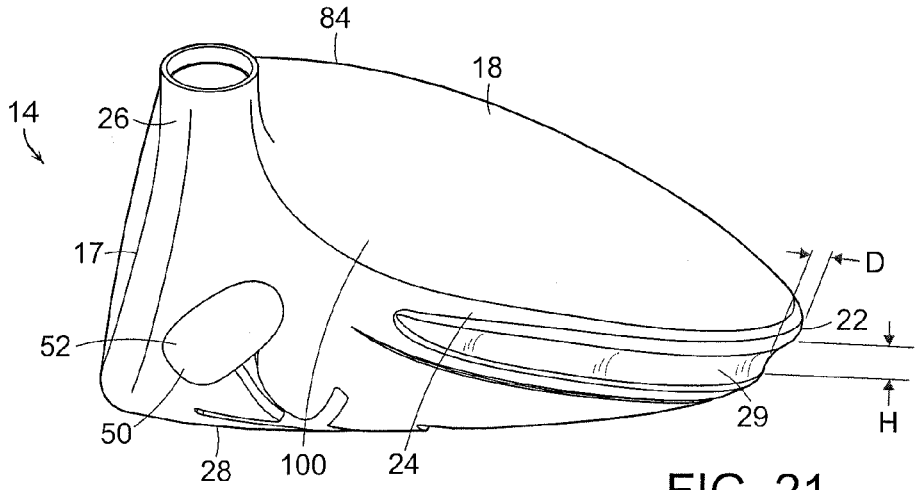
FIG. 21 is a heel-side elevation view of the club head of FIG. 17.

Referring to FIGS. 19-22, a groove 29, located below the outermost edge of the crown 18, continuously extends from a forward portion of the toe 20 to the back 22, across the back 22 to the heel 24 and into a forward portion of the heel 24. Thus, as best seen in FIG. 19, the groove 29 extends along a majority of the length of the toe 20. As best seen in FIG. 21, the groove 29 also extends along a majority of the length of the heel 24. In this particular embodiment, groove 29 is a concave groove having a maximum height (H) that may range from approximately 10 mm to approximately 20 mm and a maximum depth (D) that may range from approximately 5 mm to approximately 10 mm. Further, as best shown in FIG. 22A, sole 28 includes a shallow step 21 that generally parallels groove 29. Step 21 smoothly merges into the surface of the hosel region 26.

Figure 22A:
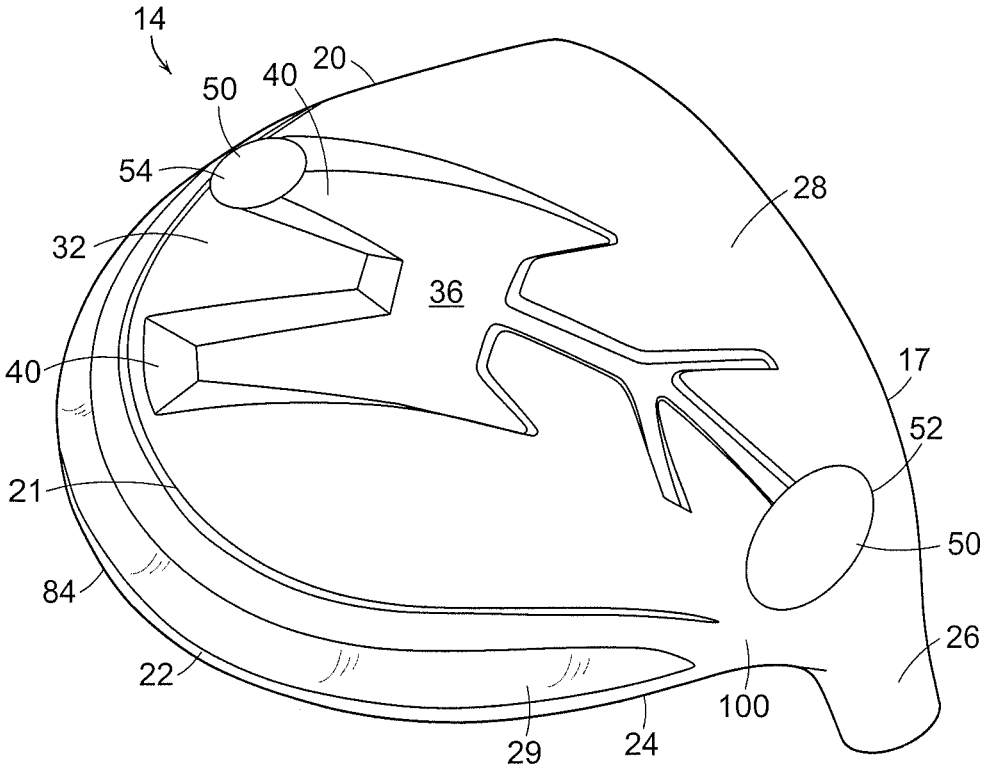
FIG. 22A is a bottom perspective view of the club head of FIG. 17.
Figure 22B:
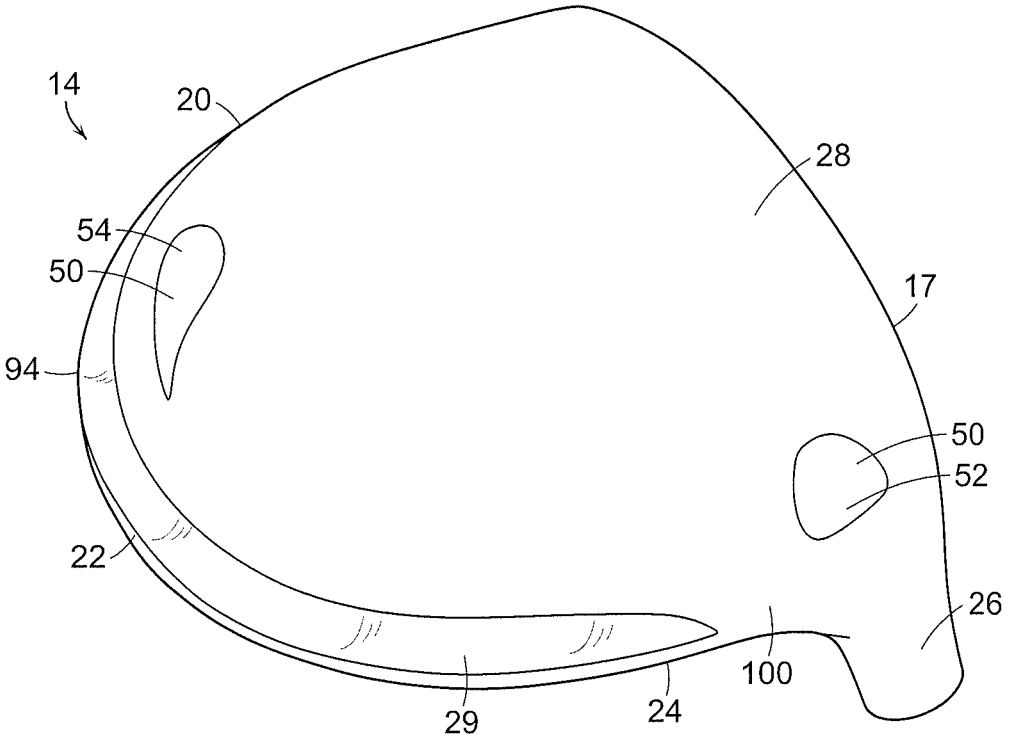
FIG. 22B is a bottom perspective view of an alternative embodiment of a club head that is similar to the club head of FIG. 17, but without a diffuser.

A diffuser 36 may be formed in sole 28, as shown in FIGS. 16A and 22A. In these particular embodiments, diffuser 36 extends from a region of the sole 28 that is adjacent to the hosel region 26 toward the toe 20, the back 22 and the intersection of the toe 22 with the back 22. In an alternative embodiment of club head 14 as shown in FIG. 22B as club head 94, the sole 28 may be formed without a diffuser.

It is expected that some of the example drag-reducing structures described in more detail below may provide various means to maintain laminar airflow over one or more of the surfaces of the club head 14 when the ball striking face 17 is generally leading the swing, i.e., when air flows over the club head 14 from the ball striking face 17 toward the back 22. Additionally, some of the example drag-reducing structures described in more detail below may provide various means to maintain laminar airflow over one or more surfaces of the club head 14 when the heel 24 is generally leading the swing, i.e., when air flows over the club head 14 from the heel 24 toward the toe 20. Moreover, some of the example drag-reducing structures described in more detail below may provide various means to maintain laminar airflow over one or more surfaces of the club head 14 when the hosel region 26 is generally leading the swing, i.e., when air flows over the club head 14 from the hosel region 26 toward the toe 20 and/or the back 22. The example drag-reducing structures disclosed herein may be incorporated singly or in combination in club head 14 and are applicable to any and all embodiments of club head 14.

According to certain aspects, and referring, for example, to FIGS. 3-6, 8-10, 11-22, a drag-reducing structure may be provided as a streamlined region 100 located on the heel 24 in the vicinity of (or adjacent to and possibly including a portion of) the hosel region 26. This streamlined region 100 may be configured so as to achieve aerodynamic benefits as the air flows over the club head 14 during a downswing stroke. In the final portion of the downswing, where the velocity of the club head 14 is significant, the club head 14 may rotate through a yaw angle of from approximately 70° to 0°. Further, due to the non-linear nature of the yaw angle rotation, configurations of the heel 24 designed to reduce drag due to airflow when the club head 14 is oriented between the yaw angles of approximately 70° to approximately 45° may achieve the greatest benefits.

Thus, due to the yaw angle rotation during the downswing, it may be advantageous to provide a streamlined region 100 in the heel 24. For example, providing the streamlined region 100 with a smooth, aerodynamically-shaped leading surface may allow air to flow past the club head with minimal disruption. Such a streamlined region 100 may be shaped to minimize resistance to airflow as the air flows from the heel 24 toward the toe 20, toward the back 22, and/or toward the intersection of the back 22 with the toe 20. The streamlined region 100 may be advantageously located on the heel 24 adjacent to, and possibly even overlapping with, the hosel region 26. This streamlined region of the heel 24 may form a portion of the leading surface of the club head 14 over a significant portion of the downswing. The streamlined region 100 may extend along the entire heel 24. Alternatively, the streamlined region 100 may have a more limited extent.

Figure 16B:
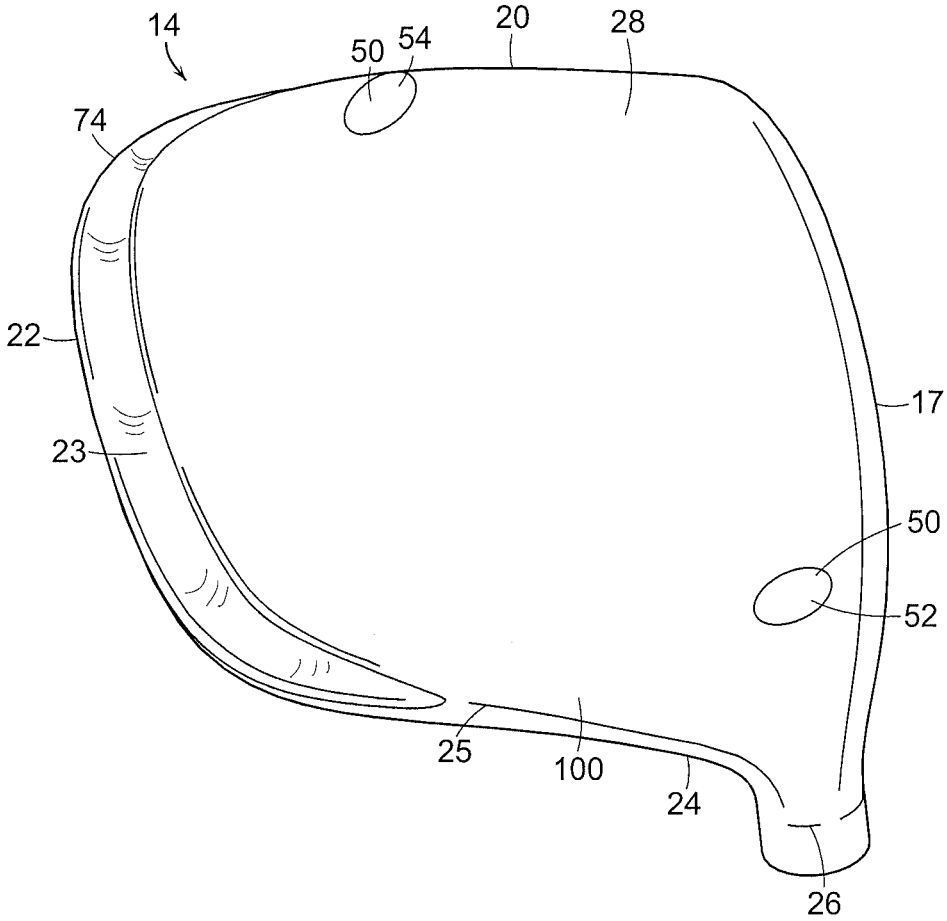
FIG. 16B is a bottom perspective view of an alternative embodiment of a club head that is similar to the club head of FIG. 11, but without a diffuser.
Figure 17:
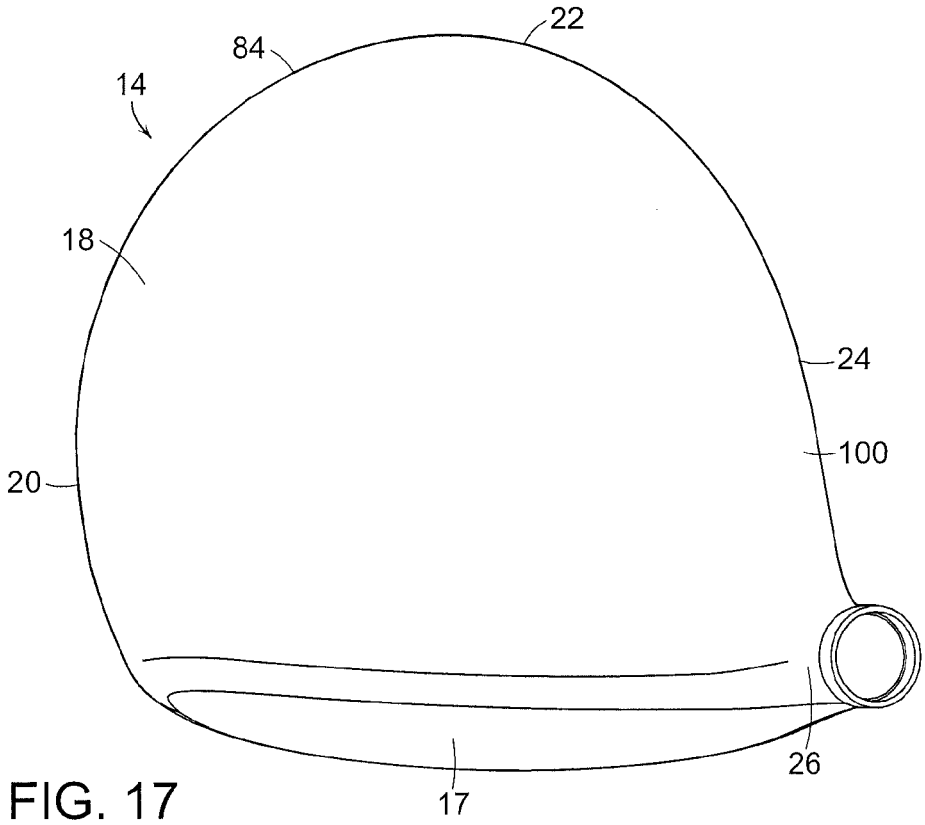
FIG. 17 is a top plan view of a club head according to other illustrative aspects.
Figure 18:
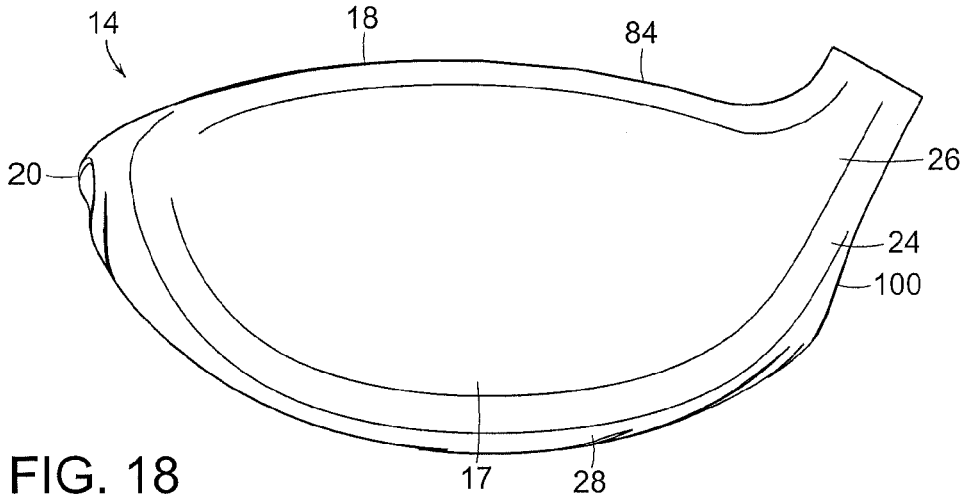
FIG. 18 is a front elevation view of the club head of FIG. 17.

According to certain aspects and as best shown in FIG. 16B, the sole 28 may extend across the length of the club head 14, from the heel 24 to the toe 20, with a generally convex, gradual, widthwise curvature. Further, the smooth and uninterrupted, airfoil-like surface 25 of the heel 24 may continue into, and even beyond, a central region of the sole 28. The sole's generally convex, widthwise, curvature may extend all the way across the sole 28 to the toe 20. In other words, the sole 28 may be provided with a convex curvature across its entire length, from the heel 24 to the toe 20.

Further, the sole 28 may extend across the breadth of the club head 14, from the ball striking face 17 to the back 22, with a generally convex smooth curvature. This generally convex curvature may extend from adjacent the ball striking surface 17 to the back 22 without transitioning from a positive to a negative curvature. In other words, the sole 28 may be provided with a convex curvature along its entire breadth from the ball striking face 17 to the back 22.

Figure 5:
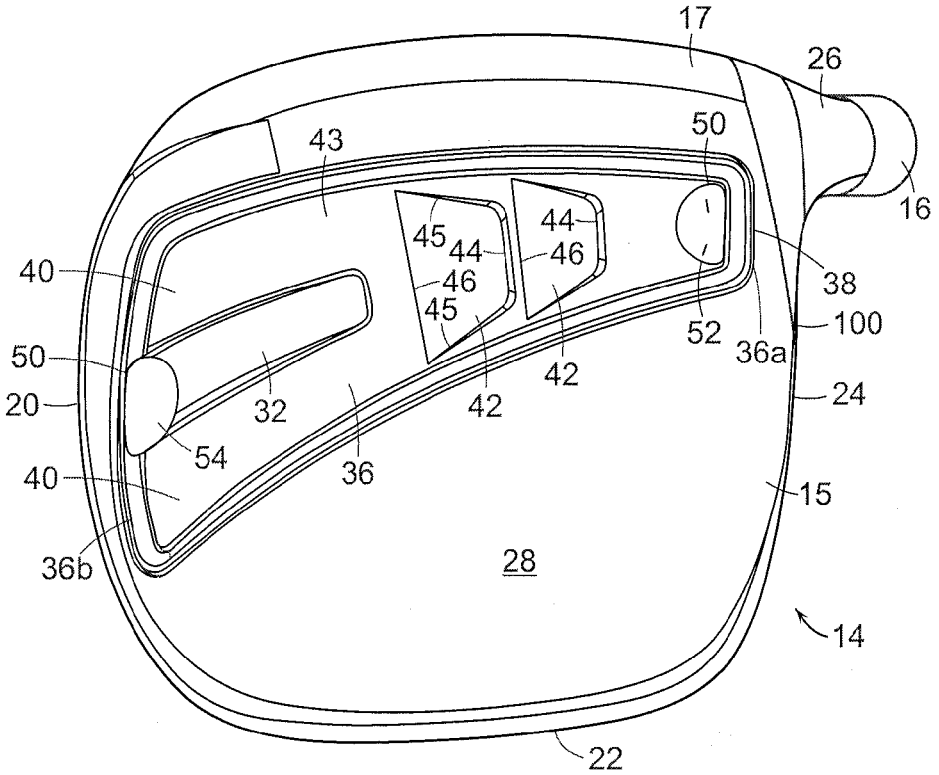
FIG. 5 is a plan view of the sole of the club head of the golf club of FIG. 1.

Alternatively, according to certain aspects, as illustrated, for example, in FIGS. 5, 16A and 22A, one or more recesses or diffusers 36 may be formed in sole 28. In the illustrated embodiment of FIG. 5, recess or diffuser 36 is substantially V-shaped with a vertex 38 of its shape being positioned proximate ball striking face 17 and heel 24. That is, vertex 38 is positioned close to ball striking face 17 and heel 24 and away from Kammback feature 23 and toe 20. Recess or diffuser 36 includes a pair of legs 40 extending to a point proximate toe 20 and away from ball striking face 17, and curving toward Kammback feature 23 and away from ball striking face 17.

Still referring to FIG. 5, a plurality of secondary recesses 42 may be formed in a bottom surface 43 of recess or diffuser 36. In the illustrated embodiment, each secondary recess 42 is a regular trapezoid, with its smaller base 44 closer to heel 24 and its larger base 46 closer to toe 20, and angled sides 45 joining smaller base 44 to larger base 46. In the illustrated embodiment a depth of each secondary recess 42 varies from its largest amount at smaller base 44 to larger base 46, which is flush with bottom surface 43 of recess or diffuser 36.

Thus, according to certain aspects and as best shown in FIGS. 5, 16A and 22A, the diffuser 36 may extend from adjacent the hosel region 26 toward the toe 20, toward the intersection of the toe 20 with the back 22 and/or toward the back 22. The cross-sectional area of the diffuser 36 may gradually increase as the diffuser 36 extends away from the hosel region 26. It is expected than any adverse pressure gradient building up in an air stream flowing from the hosel region 26 toward the toe 20 and/or toward the back 22 will be mitigated by the increase in cross-sectional area of the diffuser 36. Thus, it is expected that any transition from the laminar flow regime to the turbulent flow regime of the air flowing over the sole 28 will be delayed or even eliminated altogether. In certain configurations, the sole 28 may include multiple diffusers.

The one or more diffusers 36 may be oriented to mitigate drag during at least some portion of the downswing stroke, particularly as the club head 14 rotates around the yaw axis. The diffuser 36 may extend from the hosel region 26 toward the toe 20 and/or toward the back 22. In other configurations, the diffuser 36 may extend from the heel 24 toward the toe 20 and/or the back 22.

Optionally, as shown in FIGS. 5, 16A and 22A, the diffuser 36 may include one or more vanes 32. The vane 32 may be located approximately centered between the sides of the diffuser 36. In certain configurations (not shown), the diffuser 36 may include multiple vanes. In other configurations, the diffuser 36 need not include any vane. Even further, the vane 32 may extend substantially along the entire length of the diffuser 36 or only partially along the length of the diffuser 36.

Figure 3:
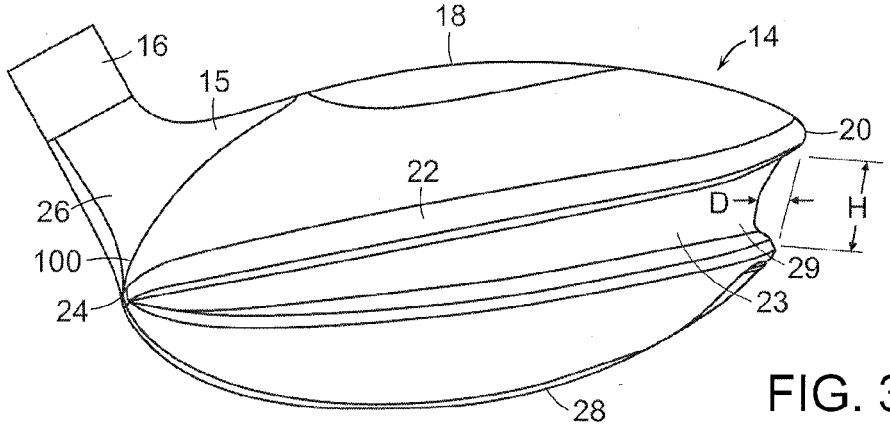
FIG. 3 is a back elevation view of the club head of the golf club of FIG. 1.
Figure 4:
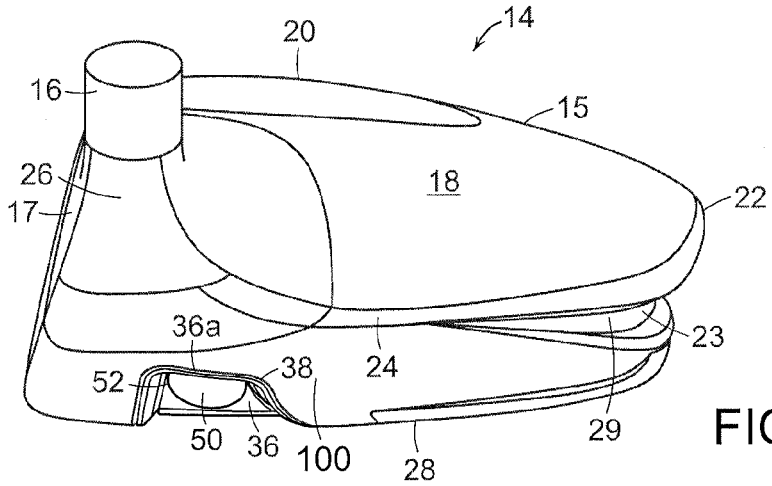
FIG. 4 is a side elevation view of the club head of the golf club of FIG. 1, viewed from a heel side of the club head.
Figure 6:
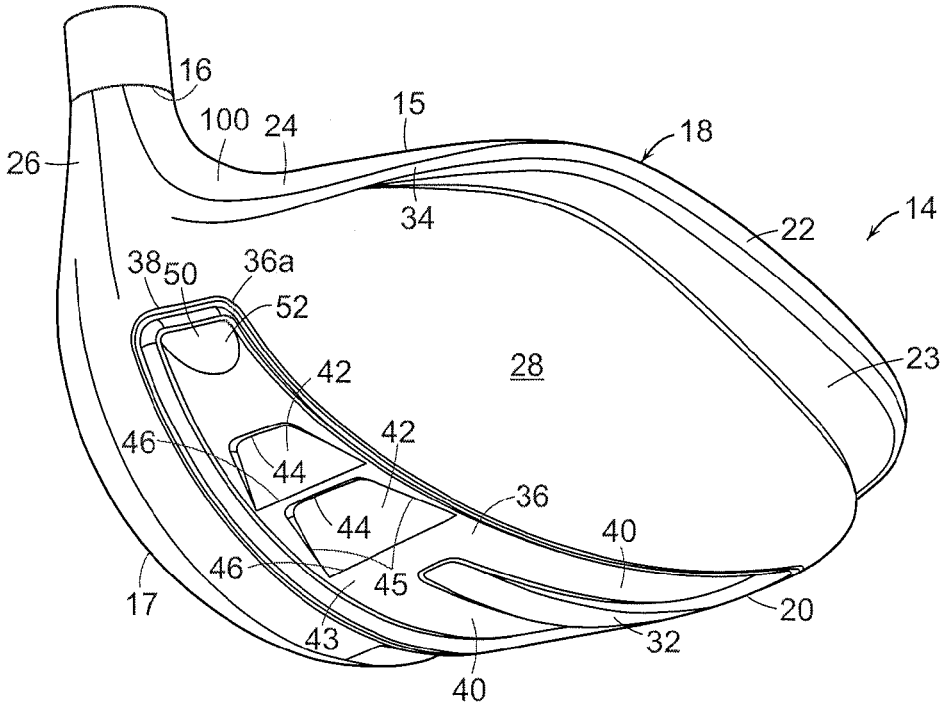
FIG. 6 is a bottom perspective view of the club head of the golf club of FIG. 1.
Figure 8:
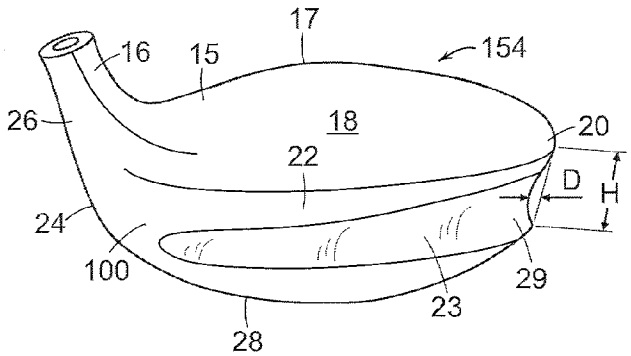
FIG. 8 is a back elevation view of the club head of FIG. 7.
Figure 10:
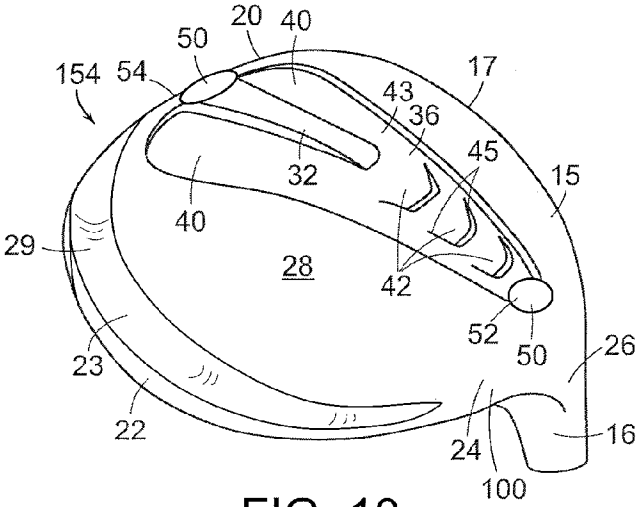
FIG. 10 is a bottom perspective view of the club head of FIG. 7.

According to other aspects and as shown according to one embodiment in FIGS. 1-6, the club head 14 may include the "Kammback" feature 23. The Kammback feature 23 may extend from the crown 18 to the sole 28. As shown in FIGS. 3 and 6, the Kammback feature 23 extends across the back 22 from the heel 24 to the toe 20. Further, as shown in FIGS. 2 and 4, the Kammback feature 23 may extend into the toe 22 and/or into the heel 24.

Generally, Kammback features are designed to take into account that a laminar flow, which could be maintained with a very long, gradually tapering, downstream (or trailing) end of an aerodynamically-shaped body, cannot be maintained with a shorter, tapered, downstream end. When a downstream tapered end would be too short to maintain a laminar flow, drag due to turbulence may start to become significant after the downstream end of a club head's cross-sectional area is reduced to approximately fifty percent of the club head's maximum cross section. This drag may be mitigated by shearing off or removing the too-short tapered downstream end of the club head, rather than maintaining the too-short tapered end. It is this relatively abrupt cut off of the tapered end that is referred to as the Kammback feature 23.

During a significant portion of the golfer's downswing, as discussed above, the heel 24 and/or the hosel region 26 lead the swing. During these portions of the downswing, either the toe 20, portion of the toe 20, the intersection of the toe 20 with the back 22, and/or portions of the back 22 form the downstream or trailing end of the club head 14. Thus, the Kammback feature 23, when positioned along the toe, at the intersection of the toe 20 with the back 22, and/or along the back 22 of the club head 14, may be expected to reduce the separation zone, and therefore reduce drag, during these portions of the downswing.

Further, during the last approximately 20° of the golfer's downswing prior to impact with the golf ball, as the ball striking face 17 begins to lead the swing, the back 22 of the club head 14 becomes aligned with the downstream direction of the airflow. Thus, the Kammback feature 23, when positioned along the back 22 of club head 14, is expected to reduce the size of the separation zone, and therefore reduce drag, most significantly during the last approximately 20° of the golfer's downswing.

Figure 9:
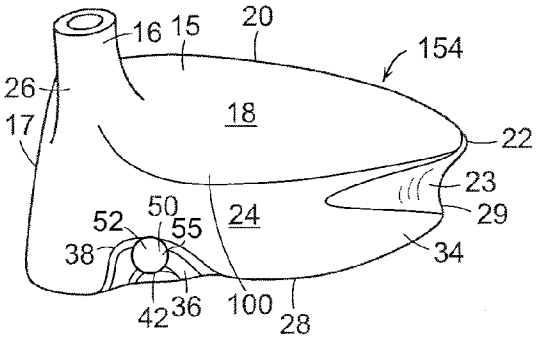
FIG. 9 is a side elevation view of the club head of FIG. 7, viewed from a heel side of the club head.
Figure 11:
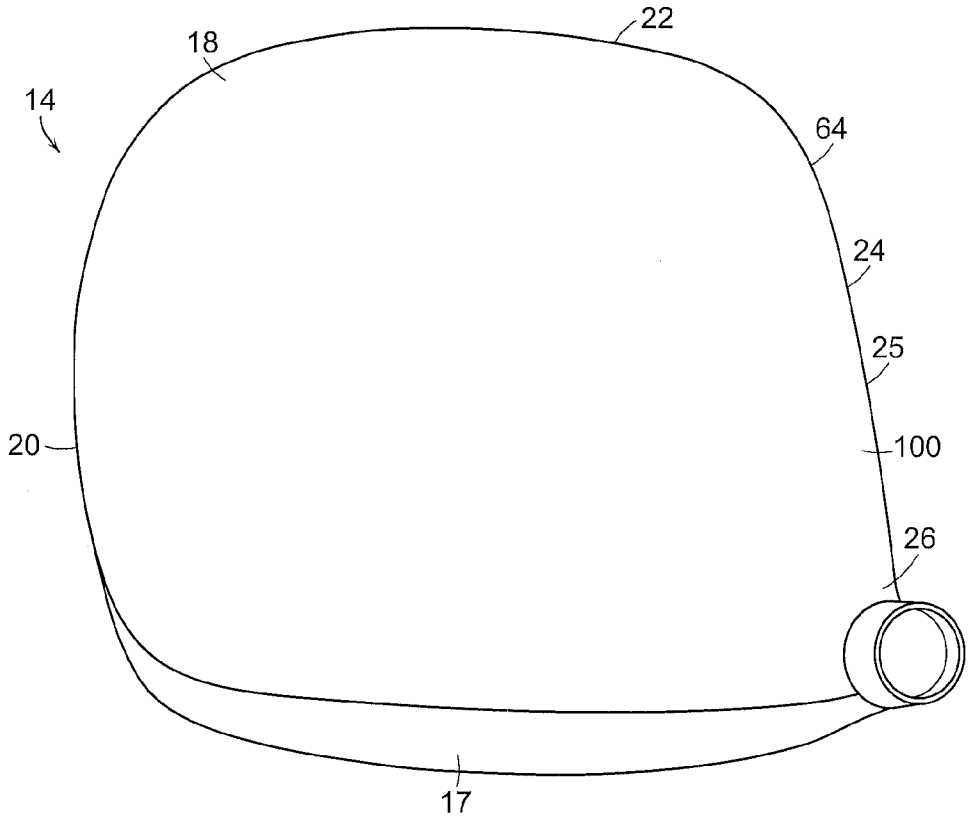
FIG. 11 is a top plan view of a club head according to certain illustrative aspects.
Figure 12:
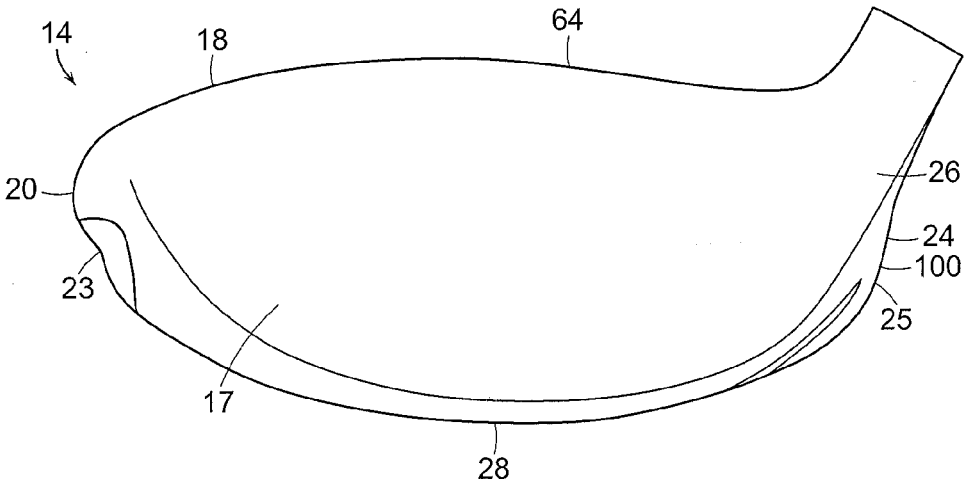
FIG. 12 is a front elevation view of the club head of FIG. 11.

Thus, for example, referring to FIGS. 7-10, a continuous groove 29 may be formed about a portion of a periphery of club head 154. As illustrated in FIGS. 7-10, groove 29 extends from a front portion 30 of toe 20 completely to a rear edge 32 of toe 20, and continues on to rear portion 22. Groove 29 then extends across the entire length of rear portion 22. As can be seen in FIG. 9, groove 29 tapers to an end in a rear portion 34 of heel 24.

Additionally, according to certain aspects, the club head 14 may include a channel 50. Channel 50 is provided as a throughbore 55 that extends from an inlet 52 located on the heel-side to an outlet 54 located on a toe-side of the club head 14. Thus, channel 50 extends across the centerline of the club head.

It is expected that channel 50 may allow air, which would otherwise impinge on the heel 24 and/or the hosel region 26 and be forced to travel around the club head 14, to flow through the club head 14 within channel 50. Without the channel 50, it is expected that this otherwise impinging air might contribute to the pressure build-up in the boundary layer flowing over the surfaces of the club head 14, thereby causing the boundary layer to separate from the club head sooner than desirable. With the channel 50, at least a portion of the otherwise impinging air simply flows through the club head 14.

According to certain aspects, the inlet 52 of the channel 50 is positioned proximate the hosel region 26 and the outlet 54 is positioned proximate the toe 20. In the illustrated embodiment of FIGS. 1-6, a diffuser 36 is also located on the sole 28. The diffuser 36 has a first edge 36*a* located to the heel-side of the centerline and a second edge 36*b* located to the toe-side of the centerline. As best shown in FIGS. 4-6, the inlet 52 may be located proximate the first edge 36*a* of the diffuser 36. As best shown in FIGS. 2 and 5, the outlet 54 may be located proximate the second edge 36*b* of the diffuser 36.

With respect to the specific diffuser 36 and the specific channel 50 illustrated in the embodiment of FIGS. 1-6, the channel inlet 52 may be positioned at the vertex 38 of diffuser 36. The channel outlet 54 may be positioned at the end of the diffuser 36 nearest the toe 20. Specifically, in this embodiment, the inlet 52 is positioned proximate the first edge 36*a* of diffuser 36 and the outlet 54 is position proximate the end of the vane 32 nearest the toe 20. Referring to FIG. 5, it is disclosed that both the inlet 52 and the outlet 54 can be seen when the club head 14 is viewed from the sole-side, i.e., along the $Z_0$ axis (see FIG. 23B). Referring to FIG. 4, it is disclosed that the inlet 52 can be seen when the club head 14 is viewed from the heel-side, i.e., along the $X_0$ axis (see FIG. 23A). Referring to FIG. 2, it is disclosed that the outlet 54 can be seen when the club head 14 is viewed from the toe-side, i.e., along the $X_0$ axis (see FIG. 23A).

Further, in the specific embodiment of FIGS. 1-6, the inlet 52 may be positioned closer to the ball striking face 17 than is the outlet 54. In other words, as channel 50 extends from inlet 52, which is adjacent to the hosel region 26, to outlet 54, which is located adjacent to the toe 20, the throughbore 55 may be angled away from the ball striking face 17. As best illustrated in FIG. 5, the inlet 52 is located approximately a quarter of the distance from the front to the back of the club head 14 and the outlet 54 is located approximately midway between the front and the back of the club head 14. In the example embodiment of FIGS. 1-6, the cross-sectional shape of the channel 50 is substantially oval-shaped.

Figure 7:
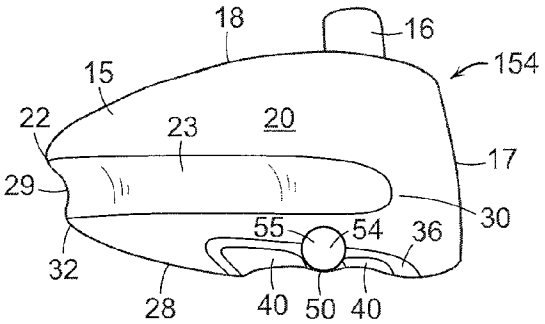
FIG. 7 is an elevation view of a club head according to certain illustrative aspects, viewed from a toe side of the club head.

Similarly, in the illustrated embodiment of FIGS. 7-10, a channel 50 may be provided wherein its inlet 52 is positioned proximate the vertex 38 of diffuser 36 and its outlet 54 is positioned proximate the end of the vane 32 nearest the toe 20. Again, the throughbore 55 may be angled away from the ball striking face 17, i.e., the inlet 52 may be positioned closer to the ball striking face 17 than is the outlet 54. Similar to the embodiment of FIGS. 1-6, in this example embodiment, as best shown in FIG. 9, the inlet 52 is located approximately a quarter of the distance from the front to the back of the club head 14. However in this example embodiment, as best shown in FIG. 7, the outlet 54 is located approximately a third of the distance from the front to the back of the club head 14. Further, in this embodiment, the channel 50 has a substantially circular cross-section.

In the embodiment of FIGS. 11-16A, the channel 50 may again be angled away from the ball striking face 17, i.e., the inlet 52 is positioned closer to the ball striking face 17 than is the outlet 54. In fact, referring to FIG. 16A, in this example embodiment, the outlet 54 may be position proximate the intersection of the toe 20 with the back 22. As illustrated in FIG. 15, the inlet 52 is located approximately a fifth of the distance from the front to the back of the club head 14. In this embodiment, the channel 50 has a substantially oval cross-section, with the cross-sectional area of the inlet 52 being less than the cross-sectional area of the outlet 54.

According to other aspects, the channel 50 need not be associated with a diffuser 36. Thus, as illustrated in FIG. 16B, a channel 50 may be provided in a club head 14 that does not include a diffuser.

In the embodiment of FIGS. 17-22A, the channel 50 may again be angled away from the ball striking face 17, with the inlet 52 positioned proximate the end of the diffuser 36 adjacent the hosel region 26 and the outlet 54 positioned proximate the end of the diffuser 36 adjacent the toe 20. Specifically, the outlet 54 is located at the end of one of the legs 40 of the diffuser 36. Further, in this embodiment, the channel 50 has a substantially oval cross-section, with the cross-sectional area of the inlet 52 being greater than the cross-sectional area of the outlet 54.

Thus, according to certain aspects and as best shown in FIGS. 5, 10, 16A, 16B, 22A and 22B, the channel 50 may extend from the hosel region 26, or from adjacent the hosel region 26, toward the toe 20, toward the intersection of the toe 20 with the back 22 and/or toward the back 22. By way of non-limiting example, the inlet 52 of the channel 50 may be located within a 4.0 cm radius of the longitudinal axis of hosel or socket 16, which is generally coincident with the longitudinal axis of the shaft 12. In certain embodiments, the inlet 52 may be located within a radius of 3.0 cm or even within a radius of 2.0 cm of the longitudinal axis of the hosel.

Figure 24A:
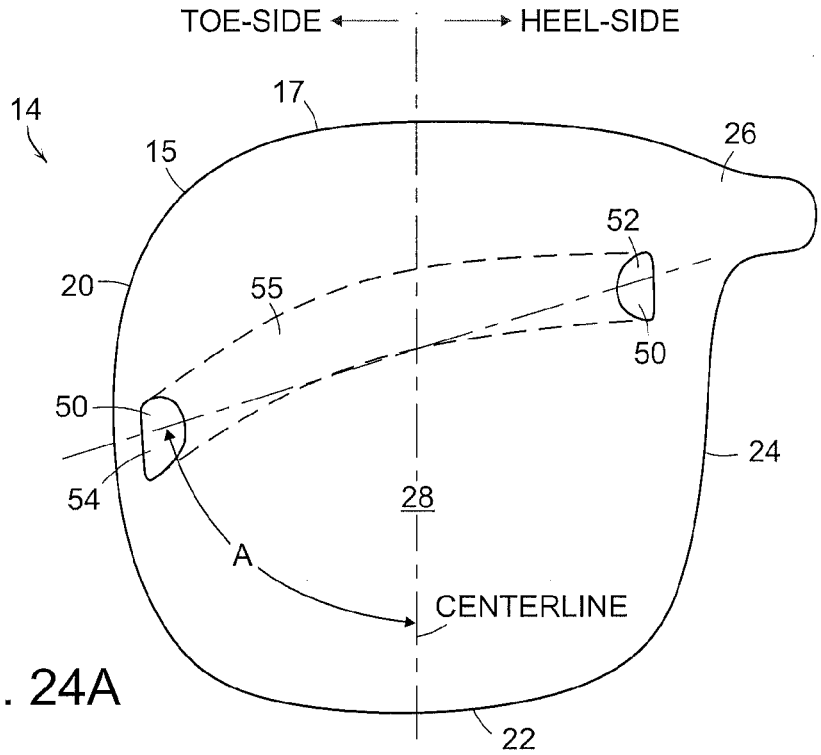
FIGS. 24A and 24B are bottom plan schematic views of a club head illustrating the profile of the throughbore of the channel according to alternative aspects.

According to certain aspects, the channel 50 may curve as it extends from the inlet 52 to the outlet 54 as shown in FIG. 24A The curvature of the throughbore 55 between the inlet 52 and outlet 54 need not be constant. Thus, for example, the curvature of the throughbore 55 may be greater closer to the outlet 54 than to the inlet 52. Curving the throughbore 52 may allow the air flowing through the throughbore to be directionally exhausted. For example, the air exiting the channel 50 at outlet 54 may be directed more toward the back 22. It is expected that directing the air flow as it exits the channel 50 may positively assist in the rotation of the club head 14. For example, by directing the exiting airflow toward the back 22, closing of the club head 14 may be promoted. According to other aspects, the channel 50 may extend linearly from the inlet 52 to the outlet 54 as shown in FIG. 24B Further, again referring to FIGS. 24A and 24B, the cross-sectional area of the throughbore 55 may be constant along the entire length of the channel. Alternatively, referring to FIGS. 25A and 25B, the cross-sectional area of the throughbore 55 may vary. For example, the area of the inlet 52 may be less than the area of the outlet 54, as shown in the embodiment of FIGS. 11-16A. By way of non-limiting example, the area of the inlet 52 may be 10% to 20% less than the area of the outlet 54. Larger differences in the area of the inlet 52 to the area of the outlet 54 may also be desirable. For example, the area of the inlet 52 in certain embodiments may be 20% to 30% less than the area of the outlet 54 or even 30% to 40% less than the area of the outlet 54. The cross-sectional area of the throughbore 55 may increase gradually and smoothly as the channel 50 extends away from the hosel region 26. A smooth and gradual increase in the cross-sectional area of the channel 50 may allow air to flow smoothly through the throughbore 55, with only minor pressure build up and minor airflow resistance, within the channel 50.

Alternatively, according to certain aspects and as illustrated in the embodiment of FIGS. 17-22A, the area of the inlet 52 may be greater than the area of the outlet 54. By way of non-limiting example, the area of the inlet 52 may be 10% to 20% greater than the area of the outlet 54. Larger differences, for example, the area of the inlet 52 in certain embodiments being 20% to 30% greater than the area of the outlet 54 or even 30% to 40% greater than the area of the outlet 54 may be desirable. By reducing the area of the outlet 54 relative to the inlet 52, a higher exhaust velocity may be achieved. This higher velocity of the exiting airflow might further assist in promoting the closing of the club head 14, especially when the outlet 54 is oriented such that the exiting airflow is directed toward the back 22 of the club head 14.

According to certain aspects, the minimum cross-sectional area of the throughbore 55 of the channel 50 may range from approximately 30 $mm^2$ to approximately 150 $mm^2$. It is expected that generally, the minimum cross-sectional area of the channel 50 may range from approximately 30 $mm^2$ to approximately 100 $mm^2$, from approximately 50 $mm^2$ to approximately 120 $mm^2$ or even from approximately 60 $mm^2$ to approximately 100 $mm^2$. A minimum cross-sectional linear dimension of the channel 50 may range from approximately 3 mm to approximately 10 mm, from approximately 4 mm to approximately 8 mm, or even from approximately 5 mm to approximately 7 mm.

According to certain aspects, the throughbore 55 of channel 50 may have a cross-sectional shape that is circular, oval, semi-circular or other regular or irregular shape. In other words, for purposes of this disclosure, the throughbore 55 need not be circular. The cross-sectional shape of throughbore 55 may be constant along the length of the channel 50. Alternatively, the cross-sectional shape may vary. For example, the inlet 52 may be substantially circular, while the outlet 54 may be substantially oval. As another option, the outlet 54 may be formed more as a thin, elongated, slit-like opening.

Figure 24B:
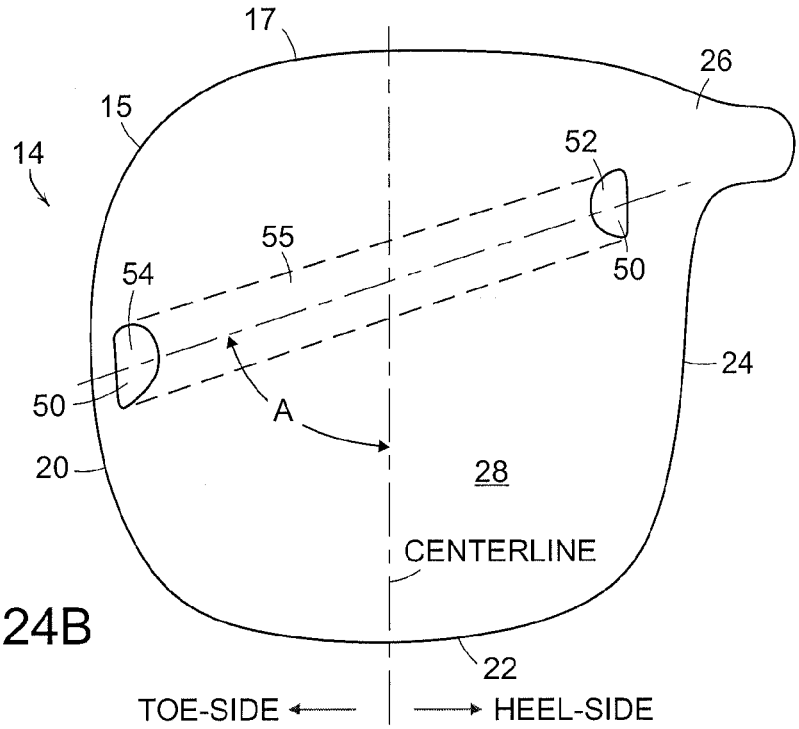
Figure 25A:
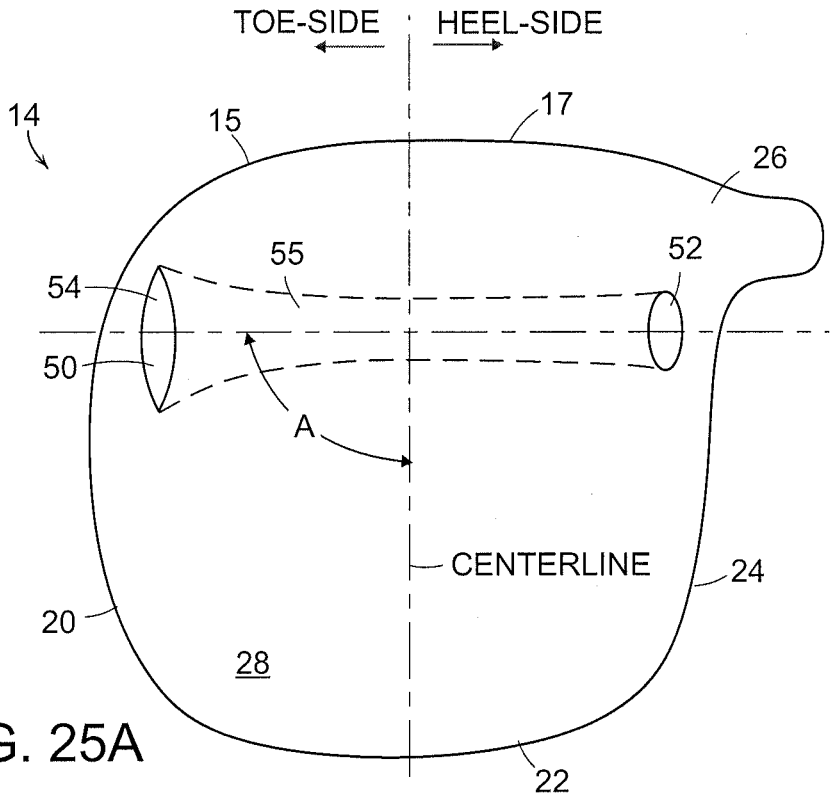
FIGS. 25A and 25B are bottom plan schematic views of a club head illustrating the profile of the throughbore of the channel according to other aspects.
Figure 25B:
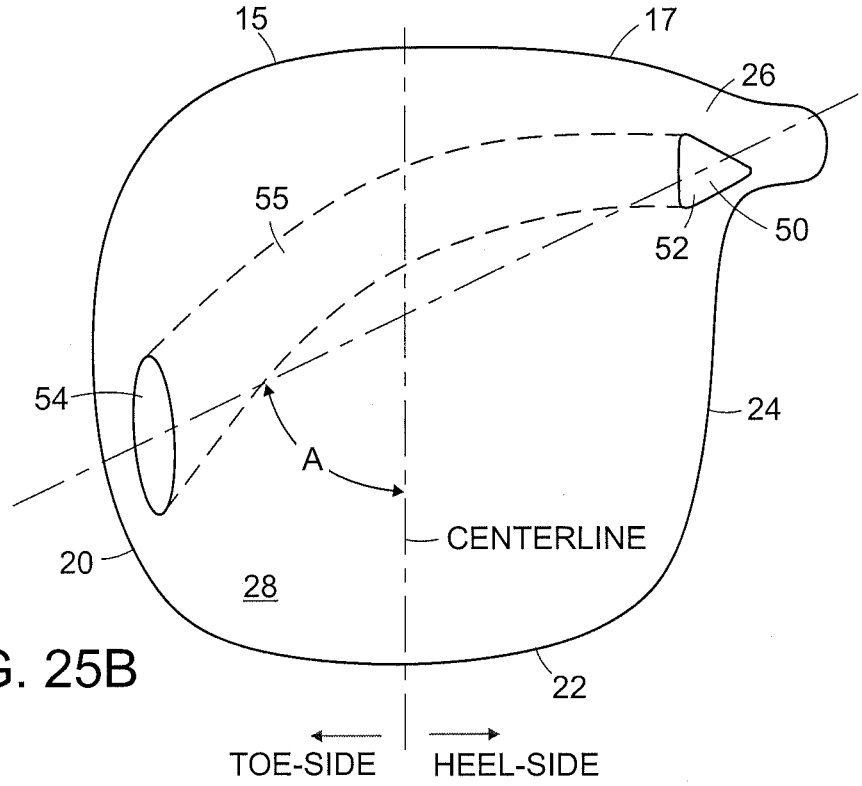

The channel 50 may be provided and oriented to mitigate drag during at least some portion of the downswing stroke, particularly as the club head 14 rotates around the yaw axis. Referring to FIGS. 24A and 24B, in certain configurations, the channel 50 may be oriented at an angle (A) from the centerline of the club head 14 in order to redirect the air flow (and thereby reduce the adverse pressure gradient) when the hosel region 26 and/or the heel 24 lead the swing. The channel 50 may be oriented at angles that range from approximately 10° to approximately 90° (i.e., perpendicular) to the centerline. Optionally, the channel 50 may be oriented at angles that range from approximately 30° to approximately 90°, or from approximately 45° to approximately 90°, or from approximately 50° to approximately 80°, or even from approximately 60° to approximately 70° from the centerline. Thus, as disclosed above, in certain configurations, the channel 50 may generally extend from the hosel region 26 toward the toe 20 and/or toward the back 22. In other configurations, the channel 50 may generally extend from the heel 24 toward the toe 20 and/or the back 22. For purposes of this disclosure, the angle of the channel 50, whether curved or straight, may be measured by drawing a straight line from the center of the inlet 52 to the center of the outlet 54.

It has been disclosed that one or more drag-reducing structures, such as the streamlined portion 100 of the heel 24, the diffuser 36 of the sole 28, the Kammback feature 23, and/or the channel 50 may be provided on the club head 14 in order to reduce the drag on the club head during at least a portion of the user's golf swing from the end of a backswing through the downswing to the ball impact location. Specifically, one or more of the streamlined portion 100 of the heel 24, the diffuser 36, the Kammback feature 23, and/or the channel 50 may be provided to reduce the drag on the club head 14 primarily when the heel 24 and/or the hosel region 26 of the club head 14 are generally leading the swing. The Kammback feature 23, especially when positioned at the back 22 of the club head 14, may also be provided to reduce the drag on the club head 14 when the ball striking face 17 is generally leading the swing. Additionally, it is expected that the airflow exiting the channel 50 may promote closing of the club head 14.

Different golf clubs are designed for the different skills that a player brings to the game. For example, professional players may opt for clubs that are highly efficient at transforming the energy developed during the swing into the energy driving the golf ball over a very small sweet spot. In contrast, weekend players may opt for clubs designed to forgive less-than-perfect placement of the club's sweet spot relative to the struck golf ball. In order to provide these differing club characteristics, clubs may be provided with club heads having any of various weights, volumes, moments-of-inertias, center-of-gravity placements, stiffnesses, face (i.e., ball-striking surface) heights, widths and/or areas, etc.

The club heads of typical modern drivers may be provided with a volume that ranges from approximately 420 cc to approximately 470 cc. Club head volumes, as presented herein, are as measured using the USGA "Procedure for Measuring the Club Head Size of Wood Clubs" (Nov. 21, 2003). The club head weight for a typical driver may range from approximately 190 g to approximately 220 g.

Referring to FIGS. 23A and 23B, other physical properties of a typical driver can be defined and characterized. For example, the club head may have a length that ranges from approximately 110 mm to approximately 130 mm and a height that may range from approximately 48 mm to approximately 62 mm. The breadth of the club head may range from approximately 105 mm to approximately 125 mm. The length, the height and the breadth are measured from opposed points on the club head when the club is sitting at a lie angle of 60° with a face angle of 0°, as shown in FIGS. 23A and 23B. (See USGA, "The Rules of Golf," Appendix II. Design of Clubs, Section 4(b)(i) and FIG. VIII.) In general, the face area may range from approximately 3000 $mm^2$ to approximately 4800 $mm^2$. The face area is defined as the area bounded by the inside tangent of a radius which blends the ball striking face to the other portions of the body member of the golf club head.

Still referring to FIGS. 23A and 23B, for typical modern drivers, the location of the center-of-gravity in the $X_0$ direction of the club head (as measured from the ground-zero point) may range from approximately 25 mm to approximately 33 mm; the location of the center-of-gravity in the $Y_0$ direction may also range from approximately 16 mm to approximately 22 mm (also as measured from the ground-zero point); and the location of the center-of-gravity in the $Z_o$ direction may also range from approximately 25 mm to approximately 38 mm (also as measured from the ground-zero point). The moment-of-inertia at the center-of-gravity around an axis parallel to the $X_0$-axis may range from approximately 2800 g-$cm^2$ to approximately 3200 g-$cm^2$. The moment-of-inertia at the center-of-gravity around an axis parallel to the $Z_0$-axis may range from approximately 4500 g-$cm^2$ to approximately 5500 g-$cm^2$.

The above-presented values for certain characteristic parameters of the club heads of typical modern drivers are not meant to be limiting. Thus, for example, for certain embodiments, club head volumes may exceed 470 cc or club head weights may exceed 220 g. For certain embodiments, the moment-of-inertia at the center-of-gravity around an axis parallel to the $X_0$-axis may exceed 3200 g-$cm^2$. For example, the moment-of-inertia at the center-of-gravity around an axis parallel to the $X_0$-axis may be range up to 3400 g-$cm^2$, up to 3600 g-$cm^2$, or even up to or over 4000 g-$cm^2$. Similarly, for certain embodiments, the moment-of-inertia at the center-of-gravity around an axis parallel to the $Z_0$-axis may exceed 5500 g-$cm^2$. For example, the moment-of-inertia at the center-of-gravity around an axis parallel to the $Z_0$-axis may be range up to 5700 g-$cm^2$, up to 5800 g-$cm^2$, or even up to 6000 g-$cm^2$.

While there have been shown, described, and pointed out fundamental novel features of various embodiments, it will be understood that various omissions, substitutions, and changes in the form and details of the devices illustrated, and in their operation, may be made by those skilled in the art without departing from the spirit and scope of the invention. For example, the golf club head may be any driver, wood, or the like. Optionally, more than one channel may be provided in the club head. Further, a channel may be configured to have a single throughbore at the inlet and multiple throughbores at the outlet, i.e., the channel may split into multiple channels as it extends from the inlet toward the outlet. Finally, it is expressly intended that all combinations of those elements which perform substantially the same function, in substantially the same way, to achieve the same results are within the scope of the invention. Substitutions of elements from one described embodiment to another are also fully intended and contemplated. It is the intention, therefore, to be limited only as indicated by the scope of the claims appended hereto.

What is claimed is:

1. A golf club head for a driver comprising:

a body member having a length dimension, a height dimension, a breadth dimension, a center-of-gravity and a face-squared centerline, the body member including a channel having an inlet, an outlet and a throughbore extending through the body member from the inlet to the outlet, the inlet located to a heel-side of the centerline of the body member, and the outlet located to a toe-side of the centerline of the body member, wherein the minimum cross-sectional area of the throughbore ranges from 30 $mm^2$ to 100 $mm^2$.

2. The club head of claim 1, wherein body member includes a hosel configured for attachment to a golf club shaft and the inlet is located within 4.0 cm of a longitudinal axis of the hosel.

3. The club head of claim 1, wherein the inlet and the outlet can be seen when the club head is viewed from a sole-side of the body member along an axis extending from the center-of-gravity in a direction parallel to the height dimension.

4. The club head of claim 1, wherein the inlet can be seen when the body member is viewed from the heel-side of the body member along an axis extending from the center-of-gravity in a direction parallel to the length dimension, and wherein the outlet can be seen when the body member is viewed from the toe-side of the body member along an axis extending from the center-of-gravity in a direction parallel to the length dimension.

5. The club head of claim 1, further including a diffuser located on a sole of the body member, the diffuser having a first edge located to the heel-side of the centerline and having a second edge located to the toe-side of the centerline, and wherein the inlet of the channel is located at the first edge of the diffuser, and wherein the outlet of the channel is located at the second edge of the diffuser.

6. The channel of claim 1, wherein the inlet is located closer to a ball striking face of the body member than is the outlet.

7. The club head of claim 1, wherein the channel is angled from 10 degrees to 90 degrees from the centerline.

8. The club head of claim 1, wherein the throughbore is at least partially curved.

9. The club head of claim 1, wherein the cross-sectional area of the inlet is less than the cross-sectional area of the outlet.

10. A golf club head for a driver comprising:

a body member having a length dimension, a height dimension, a breadth dimension, a center-of-gravity and a face-squared centerline; and the body member including a channel having an inlet, an outlet and a throughbore for a passage of air through, the channel extending through the body member from the inlet to the outlet, wherein the minimum cross-sectional area of the throughbore ranges from 30 $mm^2$ to 100 $mm^2$, wherein the inlet can be seen when the body member is viewed from a heel-side of the body member along an axis extending from the center-of-gravity in a direction parallel to the length dimension.

11. The club head of claim 10, wherein the inlet can be seen when the body member is viewed from a sole-side of the body member along an axis extending from the center-of-gravity in a direction parallel to the height dimension.

12. The club head of claim 10, wherein the outlet can be seen when the body member is viewed from the toe-side of the body member along an axis extending from the center-of-gravity in a direction parallel to the length dimension.

13. The club head of claim 10, wherein the outlet can be seen when the body member is viewed from the sole-side of the body member along an axis extending from the center-of-gravity in a direction parallel to the height dimension.

14. The club head of claim 10, wherein the outlet can be seen when the body member is viewed from the back-side of the body member along an axis extending from the center-of-gravity in a direction parallel to the breadth dimension.

15. The club head of claim 10, wherein body member includes a hosel configured for attachment to a golf club shaft and the inlet is located within 4.0 cm of a longitudinal axis of the hosel.

16. The club head of claim 10, wherein the channel is angled from 10 degrees to 90 degrees from the centerline.

17. The club head of claim 10, wherein the throughbore is at least partially curved.

18. The club head of claim 10, wherein the cross-sectional area of the inlet is less than the cross-sectional area of the outlet.

19. A golf club comprising:

a shaft; and a golf club head secured to a distal end of the shaft, wherein the golf club head comprises:

a body member having a length dimension, a height dimension, a breadth dimension, a center-of-gravity and a face-squared centerline, the body member including a channel having an inlet, an outlet and a throughbore extending through the body member from the inlet to the outlet, the inlet located to a heel-side of the centerline of the body member, and the outlet located to a toe-side of the centerline of the body member, wherein the minimum cross-sectional area of the throughbore ranges from 30 $mm^2$ to 100 $mm^2$.

* * * * *